US009951792B2

(12) United States Patent
Sinadinos et al.

(10) Patent No.: US 9,951,792 B2
(45) Date of Patent: Apr. 24, 2018

(54) APPROACH FOR FAN MOTOR MOUNTING FOR EASE OF SERVICEABILITY

(71) Applicants: DENSO International America, Inc., Southfield, MI (US); DENSO CORPORATION, Kariya, Aichi-pref. (JP)

(72) Inventors: Stephen Sinadinos, Commerce Township, MI (US); Timothy West, Livonia, MI (US); Prakash Thawani, Bloomfield Hills, MI (US)

(73) Assignees: DENSO INTERNATIONAL AMERICA, INC., Southfield, MI (US); DENSO CORPORATION, Kariya (JP)

( * ) Notice: Subject to any disclaimer, the term of this patent is extended or adjusted under 35 U.S.C. 154(b) by 242 days.

(21) Appl. No.: 14/022,831

(22) Filed: Sep. 10, 2013

(65) Prior Publication Data

US 2015/0071793 A1 Mar. 12, 2015

(51) Int. Cl.

| | |
|---|---|
| ***F04D 29/64*** | (2006.01) |
| ***F04D 25/12*** | (2006.01) |
| ***F04D 25/08*** | (2006.01) |
| *F04D 29/60* | (2006.01) |
| *F04D 19/00* | (2006.01) |

(52) U.S. Cl.

CPC ..... *F04D 29/64* (2013.01); *F04D 25/08* (2013.01); *F04D 25/12* (2013.01); *F04D 29/646* (2013.01); *F04D 19/002* (2013.01); *F04D 29/601* (2013.01)

(58) Field of Classification Search

CPC ..... F04D 29/646; F04D 29/644; F04D 29/60–29/603; F04D 19/002; F04D 25/06; F04D 25/08; F04D 25/12; F04D 25/0673

USPC ..... 123/41.49; 415/214.1; 417/363, 423.7, 417/423.14, 423.15; 310/51; 248/205.1, 248/227.4, 228.7, 231.81, 316.7, 558, 248/213.3–213.4, 223.41, 229.16, 248/229.1–229.2, 229.26

See application file for complete search history.

(56) References Cited

U.S. PATENT DOCUMENTS

| | | | | | |
|---|---|---|---|---|---|
| 1,781,155 | A * | 11/1930 | Anderson | F04D 29/646 | 415/185 |
| 1,873,343 | A * | 8/1932 | Seyfried | F04D 29/646 | 248/604 |
| 2,936,947 | A * | 5/1960 | Staak | F04D 29/626 | 417/353 |
| 3,127,092 | A * | 3/1964 | Shenberger | F04D 29/626 | 310/91 |

(Continued)

FOREIGN PATENT DOCUMENTS

| | | | |
|---|---|---|---|
| JP | S56-32100 | A | 4/1981 |
| KR | 2007-0122290 | A | 12/2007 |

*Primary Examiner* — Alexander Comley

(57) ABSTRACT

The present disclosure provides for a serviceable fan shroud motor support structure which allows for repair or replacement of individual components of the vehicle cooling module such as the fan motor or fan blades, without removing and dismantling the entire vehicle cooling module. The fan shroud motor support structure includes at least one removable spoke, which once removed, would provide access to the portion of the fan assembly requiring service or replacement. Once the repair or replacement is complete, they simply snap the previously removed spokes back into place in order to complete the repair.

10 Claims, 4 Drawing Sheets

(56) References Cited

U.S. PATENT DOCUMENTS 3,773,285 A * 11/1973 Morrill ..... F16F 15/08 244/230
3,790,114 A * 2/1974 Italiano ..... H02K 5/00 248/672
3,795,274 A * 3/1974 Fieni ..... B60K 11/04 165/122
3,830,595 A * 8/1974 Carpenter ..... F16F 15/08 248/603
4,161,812 A * 7/1979 Litch, III ..... F04D 29/282 248/606
4,685,513 A * 8/1987 Longhouse ..... F01P 5/06 123/41.49
4,759,526 A * 7/1988 Crawford ..... H02K 5/00 248/604
4,805,868 A * 2/1989 Claude ..... F01P 5/04 165/122
4,836,148 A * 6/1989 Savage ..... F01P 5/06 123/41.49
5,180,279 A * 1/1993 McLane-Goetz ..... F01P 5/04 165/135
5,341,871 A * 8/1994 Stelzer ..... F01P 5/02 165/121
5,492,456 A * 2/1996 Knight ..... F04D 29/668 248/604
5,626,202 A * 5/1997 Barnes ..... B60K 11/04 165/121
5,875,836 A * 3/1999 Nakamura ..... F28F 9/002 123/41.49
5,878,594 A * 3/1999 Lazzaro ..... B60K 11/04 62/474
6,443,714 B1 * 9/2002 Hollenbeck ..... F04D 25/08 417/423.1
6,897,580 B2 * 5/2005 White ..... F04D 29/668 310/51
7,004,732 B2 * 2/2006 Cho ..... F04D 29/582 165/121
7,287,576 B2 * 10/2007 O'Brien ..... B60H 1/00464 165/121
7,363,961 B2 * 4/2008 Mori ..... F04D 29/582 123/41.49
7,687,953 B2 * 3/2010 Rahbar ..... F04D 25/0606 123/41.49
7,771,177 B2 * 8/2010 Maillard ..... B62D 25/084 417/363
2005/0069407 A1 * 3/2005 Winkler ..... B29C 45/0062 415/58.5
2009/0162195 A1 * 6/2009 Nelson ..... F04D 29/646 415/219.1
2009/0211287 A1 * 8/2009 Steele ..... B60H 1/3229 62/259.1
2014/0312201 A1 * 10/2014 Eddisford ..... F04D 29/602 248/675

* cited by examiner

APPROACH FOR FAN MOTOR MOUNTING FOR EASE OF SERVICEABILITY

FIELD

The present disclosure relates to a serviceable structure for a vehicle cooling module assembly.

BACKGROUND

This section provides background information related to the present disclosure which is not necessarily prior art.

All internal combustion engines require some type of cooling means in order to dissipate the heat generated during the combustion process. Typical automotive applications often utilize one or more heat exchangers, which exchange heat from the engine with the cooler air of the atmosphere, via fluid coolant pumped through the engine and the one or more heat exchangers in a closed loop system.

The heat exchanger is often placed in the front of the vehicle in order to receive the most exposure to air in order to improve the efficiency of the heat exchange. Much of the air that flows through the heat exchanger is provided due to the forward motion of the vehicle (ram air), but an auxiliary fan or fans are often employed on the engine side of the heat exchanger in order to facilitate pulling air through the heat exchangers at times when forward motion of the vehicle is slow or stopped.

Associated with the one or more fans, is a shroud, which assists in directing air pulled through the heat exchanger via the fan blades. The shroud usually comprises of directing-type funnel which supports and attaches to the central fan motor(s) through a plurality of radiant spoke structures spaced around the motor allowing the air pulled from the heat exchanger to travel and exit the engine compartment.

These shroud assemblies are manufactured either by injection molding, forming, or by stamping so as to provide a monolithic structure. This design provides ease of assembly, but can cause a problem in the event that one or more of the fans, motors, or other associated components needs service. In order to service these parts, the cooling module including the shroud typically needs to be disassembled, serviced, and then reassembled, which often entails removing and reinstalling the entire cooling module, and any other components in its vicinity.

Furthermore, due to the diversity of vehicle applications, each shroud assembly is unique in design, and cannot be modified in order to address vehicle-specific issues such as fan-motor vibrations, or need for additional structural support.

SUMMARY

This section provides a general summary of the disclosure, and is not a comprehensive disclosure of its full scope or all of its features.

In light of the above mentioned short comings in the prior art, the present disclosure provides for a serviceable fan shroud motor support structure which can provide a means to repair or replace individual components of the vehicle cooling module such as the fan motor or fan blades, without removing and dismantling the entire vehicle cooling module. The service provider would merely need to remove one or more spokes in order to provide access, to the portion of the cooling module which requires service. Once the repair or replacement is complete, they simply snap the previously removed spokes back into place in order to complete the repair.

Furthermore, the proposed disclosure provides flexibility in fan shroud manufacture by allowing designers to customize the spoke locations, desired application, rigidity, and material characteristic to aid in vibration management of the assembly. This proposal would allow for the high production of simple parts which can be quickly snapped into place to hold the motor assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
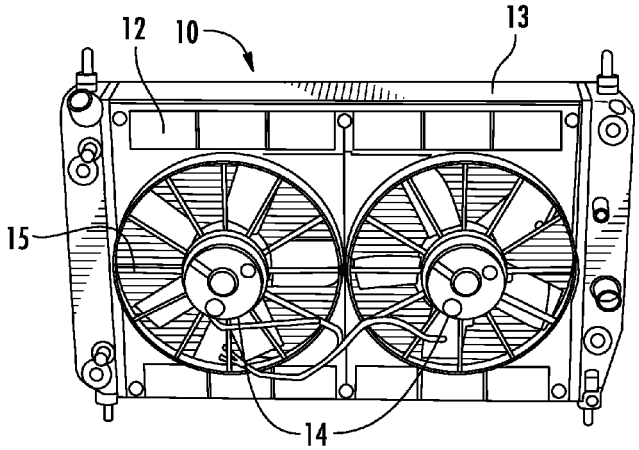
FIG. 1 is a schematic illustration of a typical vehicle cooling module depicting the preferred embodiment of the present disclosure.

Referring now to FIG. 1, a typical vehicle cooling module 10 is illustrated. The cooling module 10 comprises one or more heat exchangers 13, which exchange heat from the engine with the cooler air drawn from the atmosphere, via fluid coolant pumped through the engine and the one or more heat exchangers in a closed loop system.

In the cooling module 10, a fan shroud 12 is attached to a back side of the one or more heat exchangers 13. The fan shroud 12 acts to channel the air being drawn through the heat exchangers 13 through the one or more cooling fan openings by the fan(s). The fan motors 14 are suspended centrally to these openings by a series of support elements 15.

Figure 2:
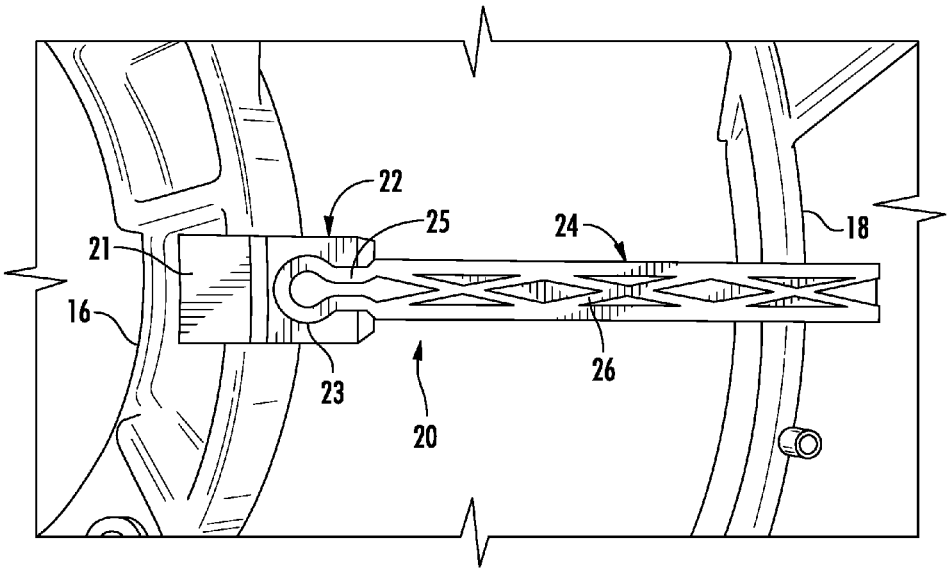
FIG. 2 is a top-side view of a removable spoke for a fan motor support, comprising a first embodiment of the present disclosure.
Figure 3:
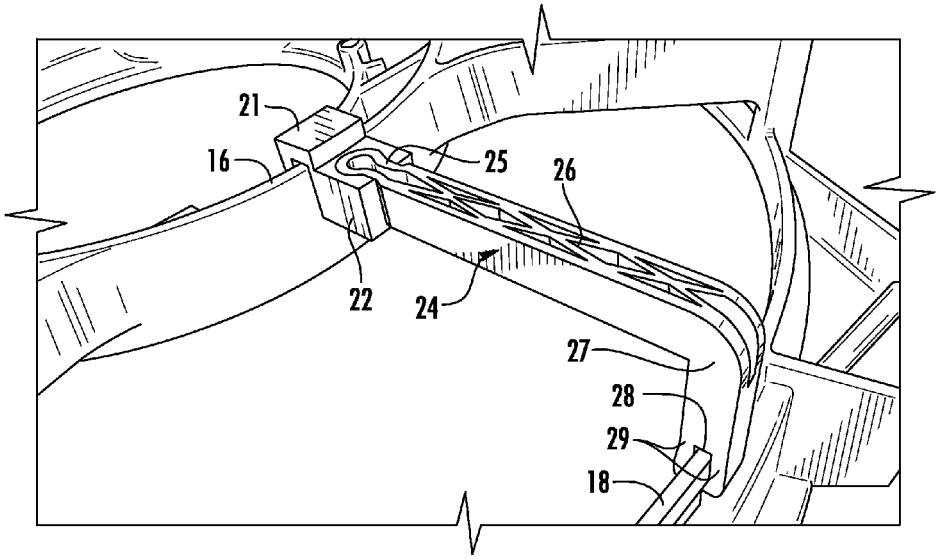
FIG. 3 is a partial perspective view of the same spoke for a fan motor support illustrated in FIG. 2.
Figure 4:
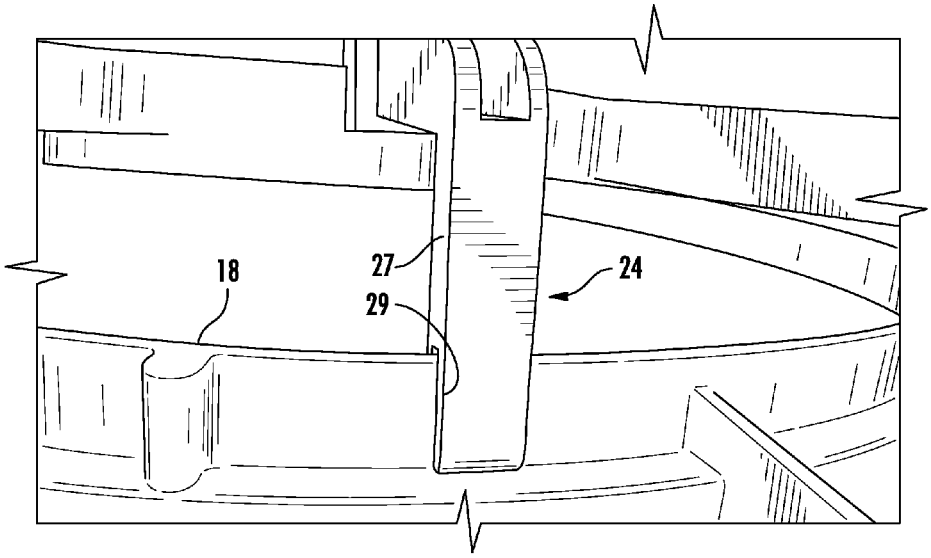
FIG. 4 is a partial perspective view of the spoke for a fan motor support shown in FIG. 3, illustrating the attachment means to the shroud.
Figure 3A:
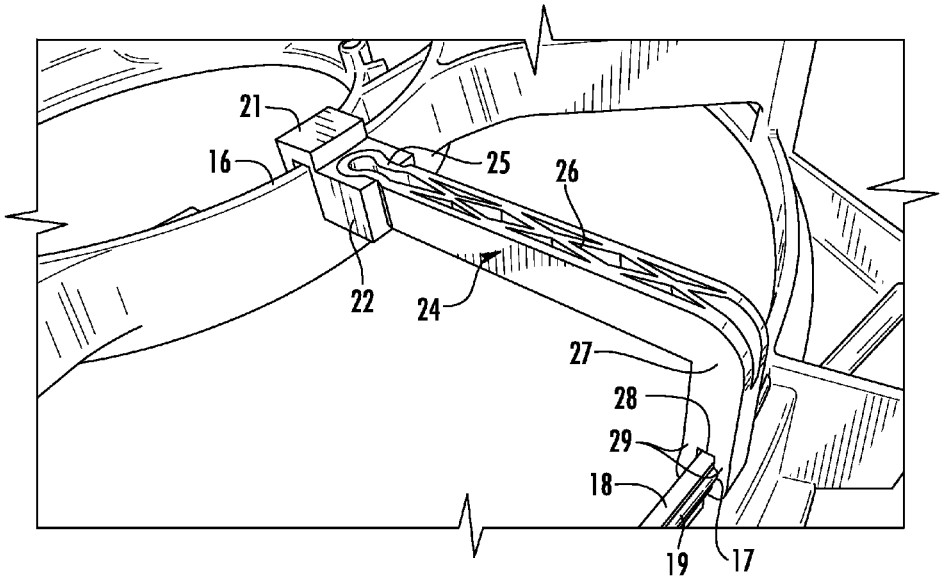
FIG. 3A is a partial perspective view of an alternative embodiment of the spoke for a motor support illustrated in FIG. 3.
Figure 4A:
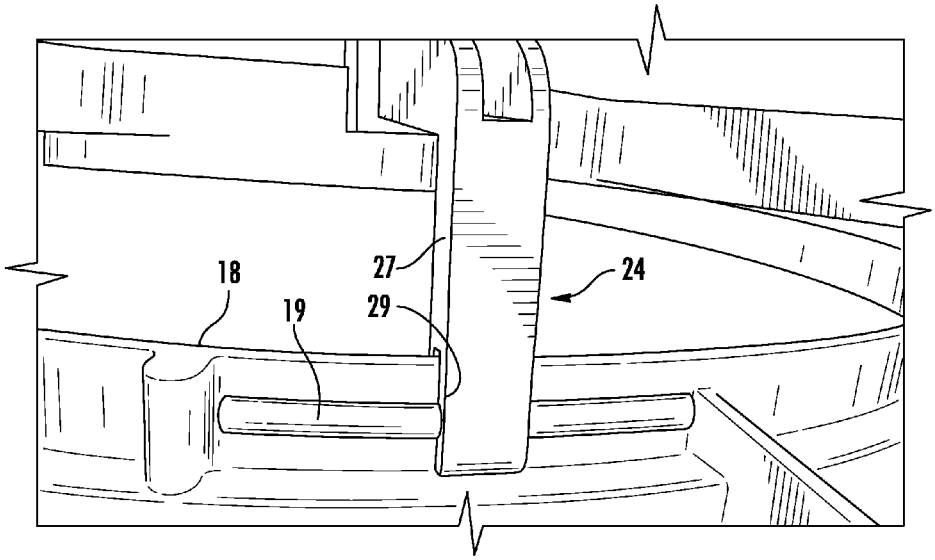
FIG. 4A is a partial perspective view of an alternative embodiment of the spoke for a motor support illustrated in FIG. 3 illustrating the attachment means to the shroud.

Referring now to FIGS. 2-4, the primary embodiment of the present disclosure comprises a plurality of removable spokes 24, wherein the details of one of the plurality of spokes 24 will be explained. The spoke 24 in general, comprises an elongated spoke body 27 which interconnects a central fan motor supporting ring 16 with the inner peripheral rim 18 of the fan shroud, separating and defining a space there between through which airflow is traversed during cooling operation of the vehicle.

The size and length of spoke body 27 is application specific, and may be straight, or may be angled outward at one end (as shown) so as to offset the motor supporting ring 16 from the shroud. The spokes 24 may employ a plurality of strengthening inner walls 26 which increase the rigidity and integrity of the spokes 24. As highlighted in FIG. 2, at the attachment point of the spoke 24 to the motor supporting ring 16, the spoke 24 may embody a separate clip 21, utilized in the attachment of the spoke 24 to the ring 16. If utilized, the clip 21 comprises a means for attaching the spoke 24 to the motor supporting ring 16, such as interference-fit groove which receives and secures the motor supporting ring 16. The clip 22 also embodies a spoke body receiving means 22, wherein in this embodiment, the spoke 24 comprises a dovetail end 25 proximal the motor supporting ring 16, which is received in the complementary spoke body receiving means 22, and provides a secure attachment means which is not susceptible to separation under normal driving conditions.

As stated above, the spoke 24 may optionally attach directly to the motor securing ring 16 through a similar interface as implemented in the clip 22, without the use of a separate clip 22, or it may be removeably attached to the ring 16 through other securing means known to one skilled in the art.

In a further embodiment, the spoke may be integrated with the motor support ring 16, and may be pivotally hinged proximal the motor support ring 16 through a living hinge or other type of hinge means.

Referring now to FIGS. 3-4, the spoke 24 further comprises a shroud attachment means 29 located proximal the inner peripheral rim 18 of the fan shroud. In this embodiment the shroud attachment means 29 comprises a similar interference-fit groove 28, which receives and secures the spoke 24 to the rim 18. Alternatively, the shroud attachment means may comprise a pair of snap able tabs with locking means that partially wrap around the peripheral beaded ring rim 18 of the shroud, or it may be removeably attached to the ring through other securing means known to one skilled in the art. Furthermore, the spoke may be integrated with the inner peripheral rim 18 of the fan shroud, and may be pivotally hinged proximal the rim 18 through a living hinge or other type of hinge means.

In a further embodiment, illustrated in FIGS. 3A-4A, the peripheral rim 18 of the fan shroud may embody one or more circumferential beads 19, positioned around the fan aperture. These beads 19 provide an additional means of securing the spoke 24 to the rim 18, wherein the groove 28 of the shroud attachment means 29 includes a complementary transverse slot 17 which receives the bead 19 when the spoke 24 is secured to the fan shroud rim 18. The bead 19 and slot 17 interlocking relationship provides an additional measure of security against unintentional separation. It is intended that the bead 19 may be incorporated on either the interior side, exterior side, or both sides of the rim 18 while still remaining within the scope of the invention. Alternatively, or in addition to the above, a similar bead and slot relationship may be employed at the spoke 24 and ring 16 interface proximal the fan motor 14. One further advantage of the bead 19 may be to provide structural reinforcement to the ring 16 and/or rim 18.

Turning now to the operation of the present disclosure, the spokes 24 provide a completely or partially removable means of securing the motor support ring 16 to the fan shroud. In the event that the fan motor or the fan blade of a vehicle cooling module assembly needs repair or replacement, the service provider simply needs to unsnap one or more of the removable spokes from the assembly while the cooling module is still on the vehicle in order to gain sufficient access to the part requiring service. After which time the serviced part is repaired or replaced, the service provides simply reinstalls the previously removed spoke(s) 24 to the assembly. In order to facilitate proper attachment, the motor support ring 16 and or the peripheral rim 18 of the fan shroud may have locating indicators for ensuring their proper reinstallation location.

Figure 5:
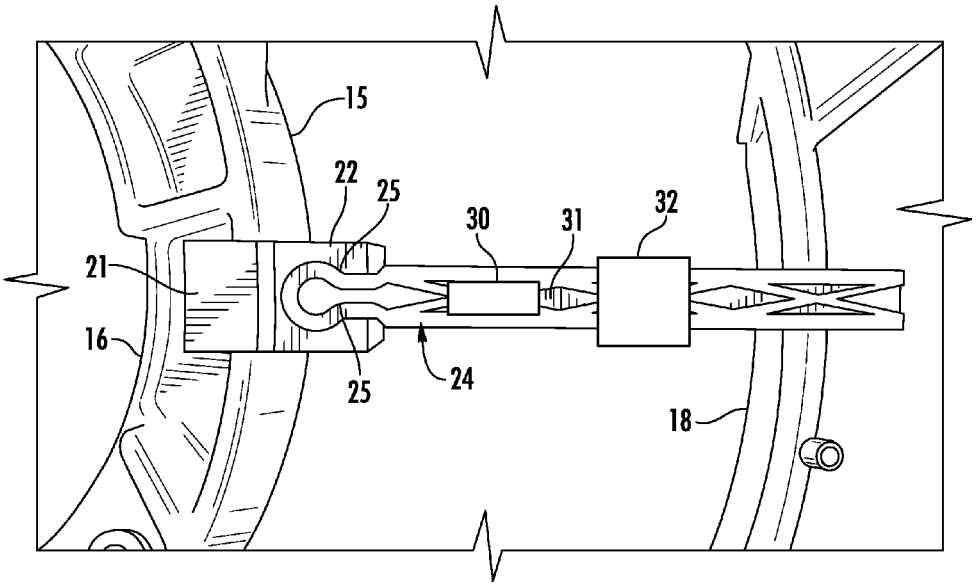
FIG. 5 is a top-side view of a removable spoke for a fan motor support, comprising a [second] further embodiment of the present disclosure.

Referring now to FIG. 5, an alternative embodiment of the present disclosure is illustrated. As mentioned previously in this description a second function of the spokes may be to offset, or absorb various vibrations generated from the fans and or their motors. In this example, the fan shroud may be one of a typical monolithic design used in the art, in which case one or more additional spokes 24 may be added to the assembly in order to damp vibrations caused by the fans/motors.

The specific locations around the periphery of the fan motor for attaching these auxiliary spokes 24 in order to maximize vibration damping can easily be configured through simple testing and tuning, such as through use of a laser vibrometer or accelerometer. As shown in FIG. 5, it may be necessary to increase the mass of the spoke(s) 24 in order to maximize the vibration damping performance, in which case one or more masses 31, 32 can be attached to the spoke 24, and positioned to minimize the vibrations accordingly. These masses 31, 32 may be clamp-on, crimp-on, clip-on, or fastened to the spoke 24 through other means known to one skilled in the art.

Alternatively, the mass of the spokes 24 themselves may be variable as well. For instance, the plurality of inner-walls 26 may define a plurality of spaces 31 within which may be filled with mass material used for offsetting any vibrations. This material may be included at the time of molding of the spoke 24, and comprise the same material as the spoke, or may be added at a later time, and may be a different material having different energy characteristics.

Alternatively, it is to be understood that in one or all of the embodiments, the spokes 24 could represent one or all of the radiant supporting means for the motor support ring, essentially allowing for the entire removal of the motor and ring 16 assembly for service or replacement.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the Figures. Spatially relative terms may be intended to encompass different orientations of the device in use or operation in addition to the orientation depicted in the Figures. For example, if the device in the Figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A fan motor support structure utilized in connection with a fan shroud for a vehicle cooling system comprising;

a fan shroud, the fan shroud being attached to at least one heat exchanger of a vehicle cooling module and having at least one aperture therethrough which air traverses, the fan shroud defining an inner fan shroud rim around the at least one aperture, at least one fan motor, the at least one fan motor having a fan blade wherein the fan motor is positioned axially centered in relation to the at least one aperture in the fan shroud, a fan motor support ring, surrounding and attaching to the at least one fan motor, and at least one removable fan motor support spoke radially interconnecting the fan motor support ring and the inner fan shroud rim and rigidly holding the fan motor support ring in place within the at least one aperture, and wherein the at least one removable fan motor support spoke is removeably attached to at least one of the fan motor support ring and the inner fan shroud rim, wherein a connecting location where the at least one removable fan motor support spoke is connected to the fan motor support ring is configured to be adjustable along a circumferential direction of the fan motor support ring, and a connecting location where the at least one removable fan motor support spoke is connected to the inner fan shroud rim is configured to be adjustable along a circumferential direction of the inner fan shroud rim, wherein the at least one fan motor support spoke includes a clip at one end thereof, the clip includes two portions that are spaced away from each other along a radial direction of the fan motor support ring, and the at least one fan motor support spoke is detachably attached to the fan motor support ring by an interference fit by clamping an edge of a rim of the fan motor support ring between the two portions, wherein the at least one fan motor support spoke is attached to the clip in a removable dovetail joint, and the clip is attached to the edge of the rim of the fan motor support ring through the interference fit.

2. The fan motor support structure of claim 1, wherein the at least one fan motor support spoke is linear in shape.

3. The fan motor support structure of claim 1, wherein the at least one fan motor support spoke is angled outward at an end proximal to the fan shroud rim, positioning the motor supporting ring axially rearward in relation to the fan shroud.

4. The fan motor support structure of claim 1, wherein the at least one fan motor support spoke comprises at least one structurally integrated inner support wall.

5. The fan motor support structure of claim 1, wherein the at least one fan motor support spoke comprises an additional mass attached thereto to offset vibrations generated in the fan shroud.

6. The fan motor support structure of claim 5, wherein the mass is removeably attached to the at least one fan motor support spoke.

7. The fan motor support structure of claim 5, wherein the mass is integrated as a single element with the at least one fan motor support spoke.

8. The fan motor support structure of claim 5, wherein the mass comprises a separate material than the at least one fan motor support spoke.

9. The fan motor support structure of claim 5, wherein the mass comprises the same material as the at least one fan motor support spoke.

10. The fan motor support structure of claim 1, wherein the at least one fan motor support spoke includes a shroud attachment means at an other end thereof, the shroud attachment means includes two portions that are spaced away from each other along a radial direction of the inner fan shroud rim, and the at least one fan motor support spoke detachably attaches to the inner fan shroud rim by an interference fit by clamping an edge of the inner fan shroud rim between the two portions.

* * * * *